United States Patent [19]

Gutzwiller

[11] 4,219,325

[45] Aug. 26, 1980

[54] AXIAL FLOW REVERSIBLE FAN FOR A HEAT TREATING FURNACE

[75] Inventor: Howard L. Gutzwiller, Zelienople, Pa.

[73] Assignee: Robinson Industries, Inc., Zelienople, Pa.

[21] Appl. No.: 922,987

[22] Filed: Jul. 10, 1978

[51] Int. Cl.[3] ..... F27D 7/04; F04D 29/54

[52] U.S. Cl. ..... 432/199; 415/192; 415/210; 415/193; 417/373

[58] Field of Search ..... 415/152 R, 152 A, 149 A, 415/149 R, 199.4, 199.5, 193, 210, 500, 191, 192; 417/373, 423 R; 432/182, 152, 199, 203, 205, 206; 266/256, 251; 34/229

[56] References Cited

U.S. PATENT DOCUMENTS

| | | | |
|---|---|---|---|
| 1,182,863 | 5/1916 | Toussaint | 417/423 R |
| 1,447,554 | 3/1923 | Jones | 415/210 |
| 2,320,733 | 6/1943 | McIntyre | 415/192 |
| 2,360,145 | 10/1944 | Lansing | 417/423 R |
| 2,463,222 | 3/1949 | Vaughan | 417/373 X |
| 2,795,394 | 6/1957 | Sliyka | 415/192 |
| 3,097,836 | 7/1963 | Beggs et al. | 432/199 X |
| 3,223,022 | 12/1965 | Powell | 432/199 X |
| 3,464,357 | 9/1969 | Duport et al. | 415/193 |

FOREIGN PATENT DOCUMENTS

| | | | |
|---|---|---|---|
| 148086 | 9/1952 | Australia | 432/199 |
| 1029265 | 6/1953 | France | 417/423 R |
| 127154 | 5/1919 | United Kingdom | 415/193 |
| 348032 | 5/1931 | United Kingdom | 415/210 |

*Primary Examiner*—Leonard E. Smith

*Attorney, Agent, or Firm*—Webb, Burden, Robinson & Webb

[57] ABSTRACT

An axial flow, reversible fan for use as a plug unit in a heat treating furnace comprises a shaft, an impeller having opposing faces mounted on an end of the shaft and comprising a tankhead and a plurality of flat blades disposed about and extending radially therefrom, a first set of fixed concavo-convex vanes disposed about and extending radially from the shaft adjacent a face of the impeller, a second set of fixed concavo-convex vanes disposed about and extending radially from the shaft adjacent the opposite face of the impeller, and a driving means for rotating the impeller which is attached to the shaft. The vanes of the first and second sets of vanes each has a cross sectional radius of curvature which varies along the length of the vane such that, for a predetermined impeller diameter and fluid flow rate, a fluid drawn across the first and second set of vanes and into the spinning impeller is deflected by the vanes so that the relative velocity of the fluid to the blade as it enters the impeller is tangent to the blade and as the fluid exits the impeller, the other set of vanes is curved so that the velocity of the fluid exiting the impeller relative to the vane is tangent to the vane and the exiting fluid is deflected so that the helical swirl of the exiting fluid is eliminated.

6 Claims, 6 Drawing Figures

AXIAL FLOW REVERSIBLE FAN FOR A HEAT TREATING FURNACE

BACKGROUND OF THE INVENTION

My invention relates to axial flow reversible fans and, in particular, to those fans adapted for use as plug units in high temperature environments such as heat treating furnaces.

It is known in the art that the use of inlet and outlet vanes with axial flow fans will improve the operating characteristics of the fan. Inlet vanes are employed to change the direction of the incoming fluid so that the velocity vector of the fluid relative to the impeller blade is always tangent to the blade. This will result in fluid flow that is parallel to the leading edge of the impeller blade and tends to decrease flow separation, also known as "shock losses." Similarly, outlet vanes are used to deflect the fluid as it exits the impeller blades and remove the tangential component of the exiting fluid velocity vector so that the helical swirl of the fluid is reduced and straight-line flow is promoted. Like the impeller blades, the outlet vanes must be curved so that the velocity of the exiting fluid relative to the vanes is tangent to the vane to minimize shock losses around the vane.

However, these systems usually employ impeller blades having a concavo-convex type cross section, as in British Pat. No. 515,469, which tends to improve fan performance for fluid flow in one direction but seriously impairs fan performance when the fan is reversed and the fluid flows in the opposite direction.

It is also known in the art to construct a reversible axial fan having a set of concavo-convex vanes on either side of the impeller. For example, the Agushev et al. U.S. Pat. No. 3,820,916 discloses a fan comprising two impellers and two sets of guide vanes arranged along the drive shaft of the fan so that the sets of vanes are separated by an impeller. Fans of this type generally are designed to operate under normal temperatures and pressures in a noncorrosive environment and have vanes and impeller blades whose pitch is adjustable to meet the required performance characteristics for forward and reverse flow. However, these fans have several significant disadvantages. In order that the fan vanes might be adjustable without dismantling the fan to adjust the pitch of the vanes, it is necessary to include in the fan construction cumbersome mechanical linkages which require periodic removal and disassembly to repair or maintain. In addition, the mechanical linkages require much space directly in the path of air flow through the fan and result in a significantly reduced air flow area for a given diameter fan. Since such reversible fans are designed to operate under a variety of required air flows and air velocities, the inlet and outlet vanes cannot compensate properly for the increase in impeller blade angular velocity with the radius of the impeller blade. As a result, inlet vanes can impart only an approximation of the proper prespin to eliminate shock losses and outlet vanes can only approximate the required pitch needed to decrease sufficiently the tangential component of the exiting fluid velocity vector and meet the exting fluid so that the velocity of the fluid relative to the vane is tangent to the vane.

SUMMARY OF THE INVENTION

In view of the disadvantages inherent in the prior art fans discussed above, it is an object of my invention to provide an axial flow reversible fan which possesses the reliability and simplicity of operation of fans having fixed inlet and outlet vanes and impeller blades while at the same time possessing the high performance and efficiency for fluid flow in either direction of fans having adjustable vanes and blades. It is a further object of my invention to provide a fan whose inlet and outlet vanes minimize the shock losses that occur upon the entry of the fluid across the impeller blades by giving the proper prespin for the leading edge of the impeller blade for each increment of the radial length of the impeller blade.

My invention is an axial flow reversible fan for use as a plug unit in a heat treating furnace which comprises an impeller mounted on a shaft and having a plurality of flat blades extending radially therefrom, a first set of fixed concavo-convex vanes disposed about and extending radially from the shaft adjacent a side of the impeller, a second set of fixed concavo-convex vanes disposed about and extending radially from the shaft adjacent an opposite side of the impeller, and a driving means attached to the shaft for rotating the impeller. The vanes of the first and second sets of vanes each have a cross sectional radius of curvature which varies along the length of the vane such that, for a predetermined impeller diameter and fluid flow rate, a fluid drawn across the first or second set of vanes and into the spinning impeller is deflected by the vanes so that the relative velocity of the fluid to the blade as it enters the impeller is tangent to the blade along the length of the blade, and as the fluid exits the impeller, the other set of vanes is curved so that the velocity of the fluid exiting the impeller relative to the vane is tangent to the vane along its length and the exiting fluid is deflected so that the helical swirl of the exiting fluid is eliminated.

DESCRIPTION OF THE PREFERRED EMBODIMENT

Essential to my invention is the proper curvature of the inlet and outlet vanes for a predetermined impeller diameter and fluid flow rate. Since, at a given impeller speed, the angular velocity of a point on the impeller blade increases as its distance from the center of the impeller increases, the curvature of the set of vanes deflecting the fluid into the impeller, the inlet vanes, must also vary with the radius to maintain the proper entry angle of the fluid leaving the vane and contacting the blade. Similarly, the fluid leaving the impeller will have a velocity that varies with the radius so that the curvature of the set of vanes deflecting the fluid exiting the impeller, the outlet vanes, also must vary in curvature to compensate for this change in velocity. In addition, the pitch of the blade and the curvature of the vanes must be such that each set of vanes is capable of both imparting the proper prespin for fluid flow in one direction and removing the angular velocity component of the fluid exiting the impeller for fluid flow in the reverse direction.

The following explanation illustrates the derivation of the equations used to calculate the proper curvature of the inlet and outlet vanes at a given radius of a vane and applies them to determine the optimum vane angles for a given application of the preferred embodiment.

Figure 1:
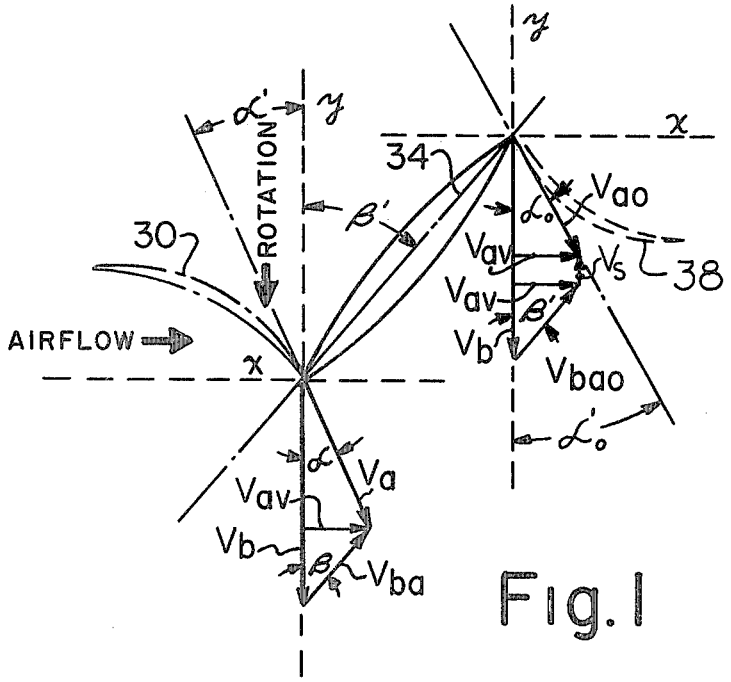
FIG. 1 is a velocity vector diagram showing the velocity of the fluid entering the impeller on the left and the velocity of the fluid leaving the impeller on the right.

FIG. 1 shows a cross section of a typical flat blade 34 of the impeller of the invention taken at a radius r from the central axis of the impeller. The blade is pitched so that it makes an angle $\beta'$ with a plane, here represented by dashed lines y, normal to the dashed lines x which are parallel to the central axis of the shaft. The angular velocity of this cross section is shown by the vectors $V_b$ drawn from the forward and rearward edges of the blade 34. The direction of $V_b$ is parallel to plane y and, at an impeller speed of w rpm, the magnitude of $V_b$ is:

$$|V_b| = 2\pi rw \tag{1}$$

The axial component of the velocity of the fluid entering the impeller is represented by $V_{av}$ and is parallel to the central axis of the impeller and dashed reference line x. The magnitude of $V_{av}$ is determined by $\dot{u}$, the volume flow rate of fluid through the fan, and the cross sectional area of the fan through which the fluid flows. For an impeller whose blades extend from the tankhead diameter $d_1$ to the tip of the impeller $d_2$, the magnitude of $V_{av}$ is:

$$|V_{av}| = \frac{\dot{u}}{\pi\left[\left(\frac{d_2}{2}\right)^2 - \left(\frac{d_2}{2}\right)^2\right]} \tag{2}$$

For the sake of simplicity, it can be assumed that $V_{av}$ is the same at any point across the face of the fan traversed by the impeller blade 34 without a large loss in accuracy.

To minimize shock losses from the flow of fluid entering the impeller represented by velocity vector $V_a$, the velocity vector of fluid entering the impeller should make an angle $\alpha$ with line y so that the vector representing the velocity of the fluid with respect to the blade, $V_{ba}$, makes an angle $\beta$ with line y equal to the angle made by the blade. Thus, when angle $\beta$ = angle $\beta'$, the velocity of the fluid relative to the blade, $V_{ba}$, is tangent to the blade which means that fluid entering the impeller is traveling parallel to the impeller blade, a condition resulting in minimal turbulence and low shock losses.

Graphically, vectors $V_b$, $V_a$, and $V_{ba}$ comprise the vector triangle shown in the lower left of FIG. 1. In order to give the fluid entering the impeller 34 the proper prespin, the edge of inlet vane 30 adjacent the blade must make an angle $\alpha'$ equal to angle $\alpha$ in the vector triangle with line y. Angle $\alpha$ and hence angle $\alpha'$ of the inlet vane can be determined from the trigomonetric relationships of the inlet vector triangle:

$$\alpha = \operatorname{arccot}\left(\frac{|V_b|}{|V_{av}|} - \cot\beta\right) \tag{3}$$

Substituting the expressions for $|V_b|$ and $|V_{av}|$ in terms of r, w, $\dot{u}$, $d_2$, and $d_1$, as given in equations (1) and (2), equation (3) becomes:

$$\alpha = \operatorname{arccot}\left(\frac{2\pi^2 rw}{\dot{u}}\left[\left(\frac{d_2}{2}\right)^2 - \left(\frac{d_1}{2}\right)^2\right] - \cot\beta\right) \tag{4}$$

Due to the frictional drag of the blade on the fluid, and the fact that a finite number of blades are used in the impeller, the vector representing the velocity of the fluid as it exits the impeller, $V_{ao}$ in FIG. 1, differs in magnitude and direction from the vector representing the velocity of the fluid as it enters the impeller, $V_a$. This change represents the slippage of the fluid along the impeller blades and is represented in the outlet vector triangle in the upper right of FIG. 1. Known as the "slip velocity," $V_s$, is opposite in direction to $V_b$ and has a magnitude determined by $\beta'$, $|V_b|$, and N, the number of impeller blades:

$$|V_s| = |V_b|\frac{\pi\sin\beta'}{N} \tag{5}$$

This relationship is explained more fully in Stodola, *Dampf und Gasturbinen,* 6th Ed., Berlin, Springer, 1924 (German).

It is desirable to eliminate the spin of the fluid exiting the impeller and to align the flow of the fluid with the axis of the fan through the use of an outlet guide vane 38, shown in section taken at a radius r from the central axis of the shaft. In order to minimize the shock losses which would be created by turbulent flow in the area of the outlet vane, it is necessary to use a guide vane that makes an angle $\alpha'_o$ with line y equal to $\alpha_o$, the angle made by the velocity vector representing the fluid exiting the impeller, $V_{ao}$. Using the trigonometric relationships of the modified outlet vector triangle in FIG. 1, angle $\alpha_o$ and hence angle $\alpha'_o$ can be found:

$$\alpha_o' = \operatorname{arccot}\left(\left(\frac{|V_b| - |V_s|}{|V_{av}|}\right) - \cot\beta'\right) \tag{6}$$

Substituting into equation (6) the expressions for $|V_b|$, $|V_s|$, and $|V_{av}|$, as given in terms of r, w, $\dot{u}$, $d_2$, $d_1$, and N as given in equations (1), (2) and (5), yields:

$$\alpha_o = \operatorname{arccot}\left(\frac{2\pi rw}{\dot{u}}\left(1 - \frac{\pi\sin\beta'}{N}\right)\left[\left(\frac{d_2}{2}\right)^2 - \left(\frac{d_1}{2}\right)^2\right] - \cot\beta'\right) \tag{7}$$

For the axial flow reversible fan of the present invention, the inlet and outlet vanes should make the same angle with the plane y. However, as a result of the presence of the slippage of the fluid with respect to the blade, represented by $V_s$, $V_a$ will be greater than $V_{ao}$ and, $V_{av}$ and angle $\beta'$ being the same for outlet conditions as for inlet conditions, angle $\alpha_o$ will be greater than angle $\alpha$. Hence angle $\alpha'_o$ should be greater than angle $\alpha$. However, to achieve optimum flow conditions for forward and reverse modes taken together, it is necessary to strike a balance between the angles $\alpha'$ and $\alpha'_o$ of the inlet and outlet vanes at each radial increment. For the purposes of the present invention, use of inlet and outlet vanes with angles that are the arithmetic average of the optimum inlet and outlet angles is sufficient. Thus, $\alpha'_r$, the angle of the inlet and outlet vanes at a given radius, is defined by the equation:

$$\alpha_r' = \frac{\alpha' + \alpha_o'}{2} \tag{8}$$

Figure 2:
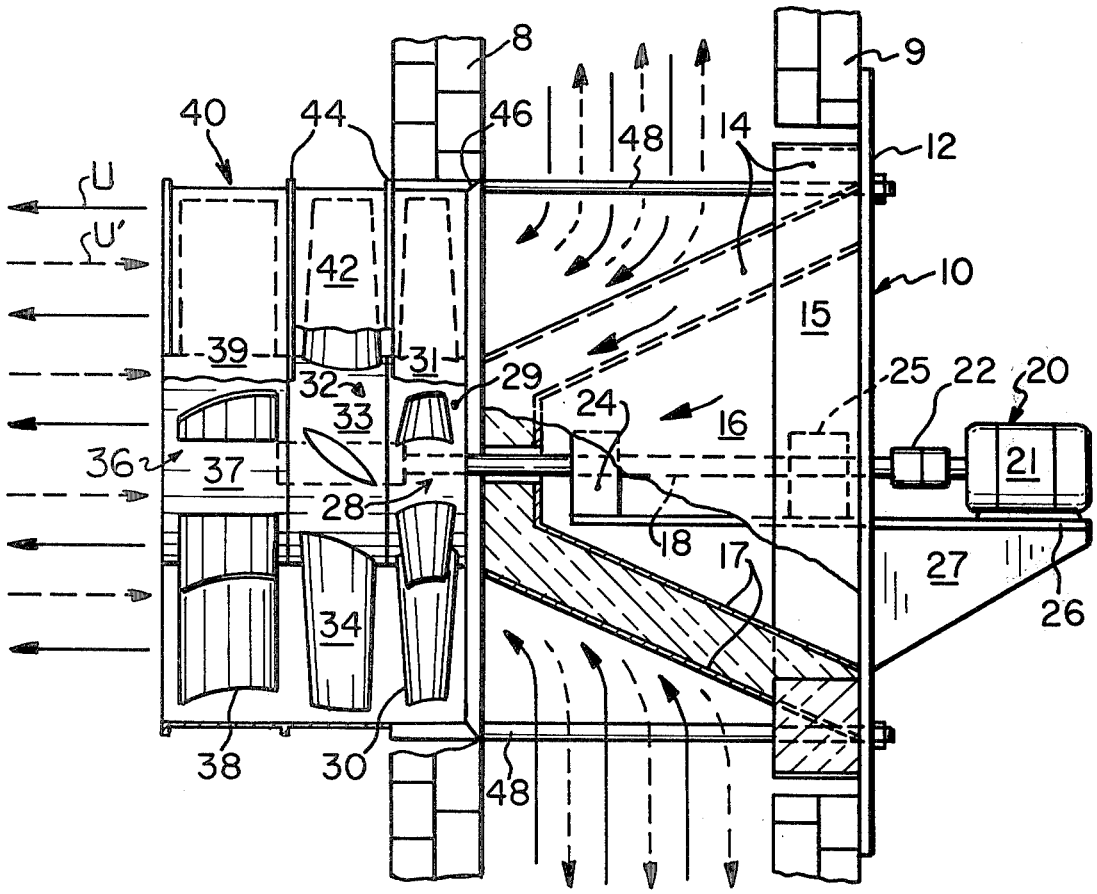
FIG. 2 is a side elevation of the preferred embodiment of the invention as installed in an annealing furnace.

For example, in the preferred embodiment shown in FIG. 2, the following values might be given for the fan design parameters for a typical industrial use: w=720 rpm, $d_2$=4.5 ft., $d_1$=1.833 ft., N=6 blades, $\dot{u}=3.0\times10^4$ ft.$^3$/min., and $\beta'=40°$. At a radius r=2.25 ft. (the tip of the impeller), the angle of the inlet vane would be calculated using equation (4) (Note that $\alpha'=\alpha$):

$$\alpha' = \text{arccot}\left(\frac{2\pi^2(2.25)(720)}{3.0\times10^4}\left[\left(\frac{4.5}{2}\right)^2 - \left(\frac{1.833}{2}\right)^2\right] - 1.1918\right)$$
$$= \text{arccot}\ (3.3089)$$
$$= 17°$$

And, $\alpha'_o$, the angle of the outlet vane at r=2.25 ft., would be found using equation (7):

$$\alpha_o' = \text{arccot}\left(\frac{2\pi^2(2.25)(720)}{3.0\times10^4}\left(1 - \frac{\pi(.64279)}{6}\right)\left[\left(\frac{4.5}{2}\right)^2 - \left(\frac{1.833}{2}\right)^2\right] - 1.1918\right)$$
$$= \text{arccot}\ (1.7946)$$
$$= 29°$$

The proper angle $\alpha_r$ at this radius for optimum reversible flow would be found using equation (8):

$$\alpha_r' = \frac{17° + 29°}{2}$$
$$= 23°$$

Thus, for the operating parameters given above, the fan of the preferred embodiment should have inlet and outlet vanes that make an angle of 23° with plane y at that section of the vanes corresponding to an impeller blade radius of 2.25 ft. A profile of the vanes could be developed by performing these calculations for incremental values of r. The preferred embodiment of the invention, generally designated 10 in FIG. 2, is known in the art as a plug unit. Typically the plug unit 10 is installed in an annealing furnace having a ceiling wall 9 and inner chamber ceiling wall 8. However, the plug unit 10 could just as easily be installed in similar openings of the side walls of the furnace. In this environment, the path of air through the fan while in the forward mode is shown by arrows U; and in the reverse mode, the air path is shown by dash arrows U'. The plug unit 10 is designed to be installed and removed easily and can be lowered into the opening wall 9 and retained in position by an overlapping mounting flange 12. Attached to the flange 12 is the insulated shaft housing 14 comprising an annular base 15 and a frusto-conical portion 16 which is encased in a metal sheath 17, all shown in section in FIG. 2. The shaft 18 passes through the center of the shaft housing 14 and flange 12 and is connected at an end to a driving means, generally designated 20, which may comprise an electric motor drive 21 connected to shaft 18 by a coupling 22 or V-belt drive assembly. Pillow block bearings 24 and 25 are located within housing 14 and support shaft 18. In this fashion, the bearings and driving means can be isolated from the harsh and often corrosive environment of the furnace. A platform 26 is supported on the plug unit 10 by a brace 27 and extends through the flange 12 into the housing 14 where it is attached to the metal sheath 17. The platform 26 supports pillow blocks 24 and 25 and driving means 20.

The inlet guide vane assembly, generally designated 28, comprises an annular inner hub 29, through which passes the shaft 18, a plurality of concavo-convex inlet guide vanes 30 extending radially outward from the hub, and a cylindrical inlet vane ring 31, shown cut away in FIG. 2, which is attached to the tips of the inlet guide vanes. The impeller, generally designated 32, comprises tankhead 33, blades 34, and sleeve 35, which fits over the shaft 18. The outlet guide vane assembly, generally designated 36, comprises an annular outer hub 37, a plurality of outlet guide vanes 38, and a cylindrical outlet vane ring 39 shown cut away in FIG. 2.

The inlet guide vane assembly 28, impeller 32, and outlet guide vane assembly 36 are enclosed in a cylindrical shroud 40. The distance between a vane and the adjacent blade is critical; it must be great enough so that the eddy currents in the fluid as it leaves the vane are permitted to stabilize and yet small enough to prevent the fluid from losing its prespin angle before contacting the blade. In the previous example, for a fan with a 54 inch diameter impeller, the distance would be approximately ½ inch. Inlet and outlet guide vane assemblies, 28 and 36 respectively, are attached to the inside wall of the cylindrical section by their vane rings, 31 and 39. The outlet vane assembly is held in place entirely by the shroud 40, while the inlet guide vane assembly 28 is further secured to the adjacent end of the shaft housing sheath 17.

The shroud 40 comprises three annular sections; a first section; outlet vane ring 39; a second section 42 encasing impeller 32; and a third section, inlet vane ring 31, all shown partially cut away in FIG. 2. The three annular sections are attached at shroud flanges 44. The third section 31 is also attached to an annular base plate 46 which is shaped to fit in an opening in the inner chamber ceiling wall 8. The shroud 40 and base plate 46 are held in place by four support rods 48 which are bolted at an end to mounting flange 12 and are attached at an opposite end to base plate 46 and the adjacent flange 44.

Although welding is recommended for joining the elements of the fan 10, bolting these parts together is acceptable. The fan may be constructed from any high temperature alloy such as 316, 309, 330, or 333 stainless steel, or Incoloy 800 or 600, the choice depending on the maximum temperature of the fan environment. The preferred embodiment is designed to recirculate air in an annealing furnace with temperatures ranging from 500F–2000F.

Figure 3:
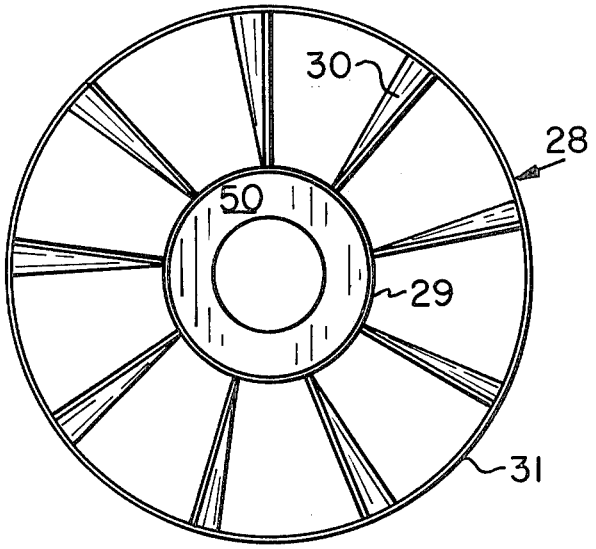
FIG. 3 is a front elevation of the inlet vane assembly as it faces the impeller.

As seen in FIG. 3, inlet guide vane assembly 28 comprises vane ring 31, nine concavo-convex vanes 30, and hub 29. Hub 29 and ring 31 are cylindrically shaped having the same central axial length. To strengthen hub 29, a washer shaped disk 50, having a central opening large enough so the disk does not interfere with the operation of shaft 18, can be attached to the hub midway along the interior and in a plane normal to the axis of the shaft. Vanes 30 have a greater curvature near the ring 31 in order to impart a greater prespin to the incoming fluid so that the velocity vector $V_{ba}$ is tangent to the impeller blade 34 (See FIGS. 1 and 4). Near the hub 29, the vanes 30 have only a slight curvature since the fluid needs only a slight prespin in order to be oriented properly with respect to the pitch of the impeller blade 34 taken at a section near the tankhead 33 having a relatively small angular velocity. As discussed supra, the inlet vane arrangement, as well as the overall design of the vane assembly shown in FIG. 3, can be duplicated in fabricating the outlet vane assembly 36 (See FIGS. 1 and 2), keeping in mind that the vane assembly is mounted on the fan so that the portion of the vane with the desired angle of curvature is adjacent the impeller and the portion of the vane that extends parallel to the axis of the shaft is the furthest from the impeller.

Figure 4:
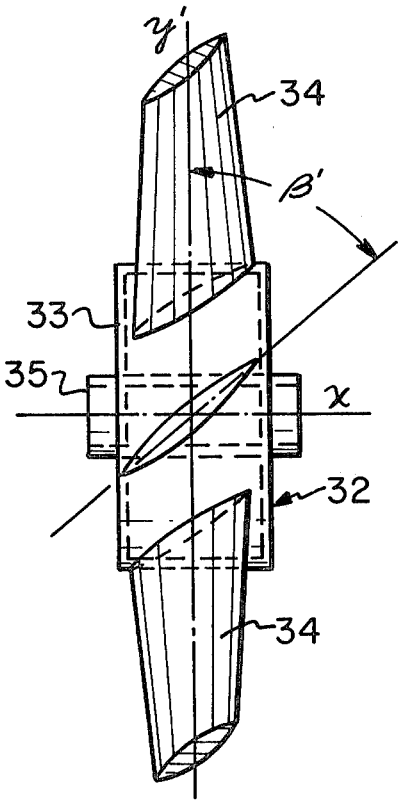
FIG. 4 is a side elevation of the impeller of the preferred embodiment.

In FIG. 4, the arrangement of blades 34 about the tankhead 33 of the impeller 32 is shown. To reduce further the turbulence created by the passage of the fluid over the blades 34, the blades have an airfoil cross section. Tankhead 33 is hollow and doughnut shaped, having a central axial opening in which a sleeve 35 is fitted to engage shaft 18 so that the shaft and impeller 32 rotate as one. Sleeve 35 may be fitted with a key slot or set screw (not shown) to prevent rotation of the impeller 32 with respect to the shaft 18.

The blades 34 are pitched at an angle $\beta'$ measured from a plane normal to the shaft axis x', which typically is approximately 40°. A value of $\beta'$ much larger or smaller than 40° would result in high losses.

Figure 5:
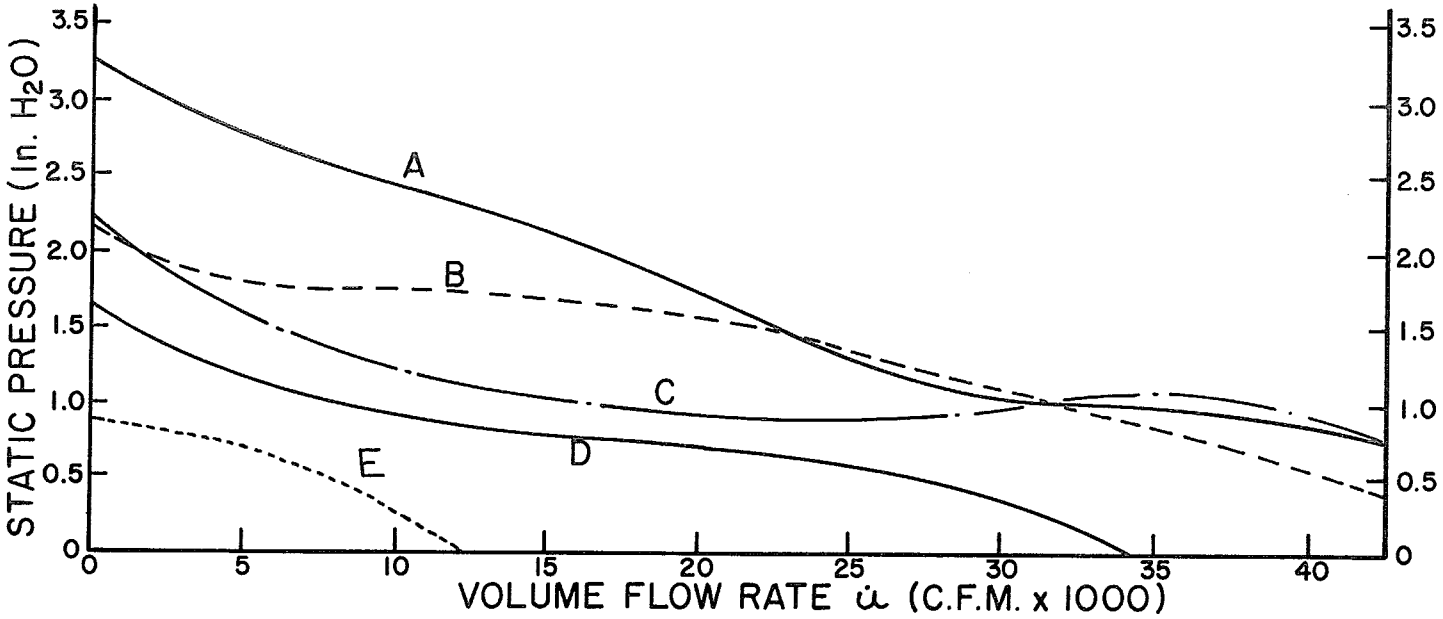
FIG. 5 is a graph showing the volume flow rate in thousands of cubic feet per minute plotted against the static pressure in inches of water for the preferred embodiment of the present invention and a comparable fan of the prior art.

The performance of the preferred embodiment of the invention 10 (FIG. 2) compared to a similarly sized fan having typical concavo-convex blades is shown graphically in FIG. 5. The similarly sized curved bladed fan operating in the forward mode, represented by line A, outperforms the fan of the present invention in both the forward and reversed modes, represented by lines B and C respectively, at low values of $\dot{u}$. However, for higher values of $\dot{u}$, typical of those required for industrial use, performance of the fan of the present invention in both modes equals and under certain conditions exceeds the performance of the curved bladed fan. The performance of a curved bladed fan operating in the reverse mode, shown by line D, does not approach the performance of the fan of the present invention. The graph of FIG. 5 reveals the most significant advantage of the present invention; namely, that the use of a flat bladed impeller in combination with inlet and outlet vanes, curved in accordance with the formulae discussed supra, results in a fan which can operate in forward or reverse modes at performance levels comparable to that of a curved bladed fan in the forward mode, for typical industrial applications.

To illustrate further the importance of the guide vanes when the straight bladed impeller is used, a plot of the performance of a fan of the present invention, operated without guide vanes, appears as line E in FIG. 5. From line E, it is apparent that the use of guide vanes, curved in accordance with the foregoing formulae, is critical to the performance of the flat bladed impeller of the present invention.

Figure 6:
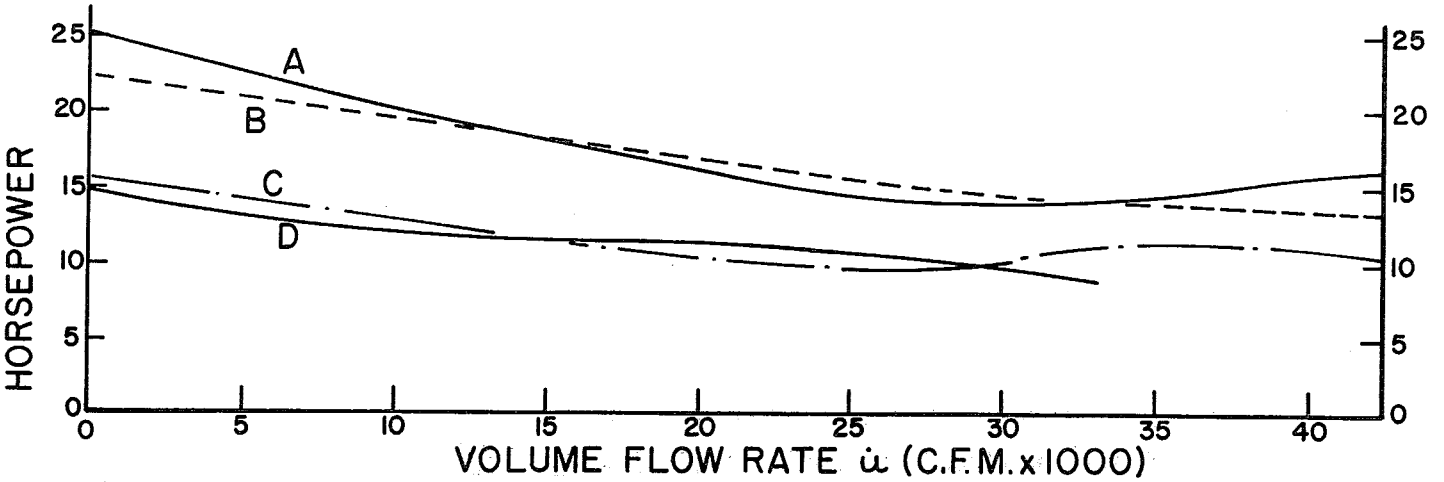
FIG. 6 is a graph showing the volume flow rate in thousands of cubic feet per minute, plotted against horsepower developed for the fan of the present invention and a typical prior art.

FIG. 6 illustrates the efficiency of the fan of the present invention in the forward and reverse modes when compared to the similarly sized curved bladed fan in the forward mode. This graph shows that the horsepower developed by the fan of the present invention in both the forward and reverse modes compares favorably with the curved bladed fan at typical industrial volume flow rates.

The graphs of FIGS. 5 and 6 demonstrate that a fan of the present invention can operate in the forward or reverse mode with little loss in performance and that the fan in either mode compares favorably with the standard curved bladed fan. Although the novel design involved has been described as embodied in a reversible flow plug unit to be used in the corrosive environment of an annealing furnace, this combination of inlet and outlet vane assemblies with a substantially flat bladed impeller can be used wherever axial flow reversible fans are needed.

I claim:

1. In a reversible flow plug unit for a heat treating furnace having an inner chamber and an outer chamber enclosing and communicating with said inner chamber, said inner and outer chambers having openings aligned to receive said plug unit; said plug unit having a shaft extending through said openings; an impeller mounted on said shaft and having opposing faces and a plurality of substantially flat blades extending in a radial direction; and a driving means attached to said shaft; the improvement comprising:

a first set of fixed concavo-convex vanes disposed about and extending radially from said shaft and located adjacent a face of said impeller and between said impeller and said driving means;

a second set of fixed concavo-convex vanes disposed about and extending radially from said shaft adjacent an opposite face of said impeller;

said vanes of said first and second sets of vanes each having a cross sectional radius of curvature which varies along the length of said vane such that, for a predetermined impeller diameter and fluid flow rate, a fluid drawn across said first or second set of vanes and into said spinning impeller is deflected by said first or second set of vanes so that the velocity of said fluid relative to said impeller blades is substantially tangent thereto at all radii, and as said fluid exits said impeller, the other set of vanes is curved so that the velocity of the exiting fluid relative to said other set of vanes is substantially tangent so said other set of vanes at all radii;

said vanes further having a leading portion adjacent said impeller and a trailing portion opposite said impeller, said trailing portion having a curvature such that it deflects said fluid exiting said impeller so that the velocity of said fluid is substantially parallel to said shaft;

a mounting flange located adjacent a wall of said outer chamber and between said driving means and said first set of vanes, said mounting flange having an opening through which extends said shaft; and an insulated shaft housing attached to said mounting flange and positioned along said shaft between said wall of said outer chamber and a proximate wall of said inner chamber.

2. The plug unit of claim 1 wherein said impeller blades make an angle to a plane normal to said shaft of between 30° and 50°.

3. The plug unit of claim 1 wherein said sets of vanes are spaced from said impeller at a distance such that eddy currents in a fluid passing over said vanes and into said impeller can stabilize yet maintain their directional orientation with respect to the leading edge of the blade.

4. The plug unit of claim 1 wherein said curvature of said trailing portion is such that a fluid drawn across said trailing portion and into said impeller has a velocity tangent to said trailing portion at the time said fluid first contacts said vane.

5. The plug unit of claim 1 wherein said vanes of said first and second sets of vanes make an angle with a plane normal to said shaft, said angle varying with the radius such that $\alpha_r$, the angle made by a portion of a vane adjacent said impeller with said plane, lies between the angles of $$\cot^{-1}\left(\frac{2\pi^2 rw}{\dot{u}}\left[\left(\frac{d_2}{2}\right)^2-\left(\frac{d_1}{2}\right)^2\right]-\cot\beta\right)$$

and $$\cot^{-1}\left(\frac{2\pi rw}{\dot{u}}\,1-\frac{\pi\sin\beta}{N}\right)\left[\left(\frac{d_2}{2}\right)^2-\left(\frac{d_1}{2}\right)^2\right]-\cot\beta\Bigg)$$

inclusive, where r is the radius of set of vanes at which the cross section is taken, w is the speed of the impeller, $\dot{u}$ is the volume flow rate of the fluid, $\beta$ is the angle of said impeller blade with said plane, N is the number of said blades, $d_2$ is the outside radius of said blades, and $d_1$ is the outside radius of said tankhead.

6. The fan of claim 5 wherein $30° \leqq \beta \leqq 50°$, $4 \leqq N$, and the first and second sets of vanes each comprise at least six vanes.

* * * * *